United States Patent [19]

Juhas

[11] Patent Number: 4,980,126

[45] Date of Patent: Dec. 25, 1990

[54] PROCESS FOR HIP CANNING OF COMPOSITES

[75] Inventor: John J. Juhas, Columbia Station, Ohio

[73] Assignee: The United States of America as represented by the Administrator of the National Aeronautics and Space Administration, Washington, D.C.

[21] Appl. No.: 433,863

[22] Filed: Nov. 9, 1989

Related U.S. Application Data

[63] Continuation-in-part of Ser. No. 326,757, Mar. 21, 1989, Pat. No. 4,904,538.

[51] Int. Cl.[5] ..... B22F 3/14

[52] U.S. Cl. ..... 419/49; 419/8; 419/24; 419/36; 419/37; 419/48; 419/54; 419/60; 428/552

[58] Field of Search ..... 419/8, 24, 36, 37, 48, 419/49, 54, 60; 428/552, 551

[56] References Cited

U.S. PATENT DOCUMENTS

| | | | |
|---|---|---|---|
| 3,714,702 | 2/1973 | Hammond | 29/494 |
| 3,940,268 | 2/1976 | Catlin | 491/49 |
| 4,104,782 | 8/1978 | Veeck et al. | 29/527.2 |
| 4,110,131 | 8/1978 | Gessinger | 148/11.5 N |
| 4,212,669 | 7/1980 | Veeck et al. | 75/226 |
| 4,335,192 | 6/1982 | Oliapuram | 419/37 |
| 4,448,747 | 5/1984 | Moritoki et al. | 419/49 |
| 4,554,130 | 11/1985 | Ecer | 419/8 |
| 4,587,096 | 5/1986 | Mankins et al. | 419/27 |
| 4,599,215 | 7/1986 | Smarsly et al. | 419/42 |
| 4,673,549 | 6/1987 | Ecer | 419/10 |
| 4,871,621 | 10/1989 | Bagley et al. | 428/549 |
| 4,904,538 | 2/1990 | Juhas | 428/552 |

*Primary Examiner*—Stephen J. Lechert, Jr.
*Assistant Examiner*—Ngoclan Mai
*Attorney, Agent, or Firm*—Gene Shook; James A. Mackin; John R. Manning

[57] ABSTRACT

A single step is relied on in the canning process for hot isostatic pressing metallurgy composites. The composites are made from arc-sprayed and plasma sprayed monotape. The HIP can is of compatible refractory metal and is sealed at high vacuum and temperature. This eliminates out-gassing during hot isostatic pressing.

12 Claims, 3 Drawing Sheets

PROCESS FOR HIP CANNING OF COMPOSITES

ORIGIN OF THE INVENTION

The invention described herein was made by an employee of the United States Government and may be manufactured and used by or for the Government for governmental purposes without the payment of any royalties thereon or therefore.

STATEMENT OF COPENDENCY

This application is a continuation-in-part of application Ser. No. 326,757 which was filed Mar. 21, 1989, and issued as U.S. Pat. No. 4,904,538

TECHNICAL FIELD

This invention is directed to an improved process for canning composites. The invention is particularly concerned with canning composites made from arc sprayed and plasma sprayed monotape.

One conventional method for canning a specimen for hot isostatic pressing is to lay up the specimen in a refractory metal can that is electron beam welded closed in a vacuum. This can with the vacuum sealed inside is then ready for hot isostatic pressing.

The main disadvantage to this process is that the vacuum in the can is sealed in at room temperature and subsequent heating in the HIP operation can cause outgassing in the canned specimen. This results in poor densification, and in certain specimens this residual gas will react with the specimen degrading the materials properties. This is especially a problem with arc-sprayed and plasma sprayed composite monotapes because their rough surfaces tend to trap contaminants. Also, their porous nature makes it very difficult to thoroughly remove all the air during a standard canning process.

Inasmuch as the can is electron beam welded there is a potential for cracks in the welds due to the recrystallization of the refractory metal in the heat-affected weld zone. This cracking of the weld prevents the specimen from densifying in the HIP operation.

Another disadvantage is that the HIP cans have to be formed to the approximate size of the specimen. Due to variations in the specimen's dimensions, these cans cannot be a perfect fit. As deformation of the can occurs in the HIP operation, uneven stresses can occur causing warping of the specimen.

It is, therefore, an object of the present invention to provide a one step, ideal, and economical method of canning composites made from arc-sprayed and plasma sprayed monotape.

BACKGROUND ART

Veeck et al U.S. Pat. Nos. 4,104,782 and 4,212,669 disclose methods for consolidating precision shapes wherein powder particles are consolidated into shaped porous preforms. Coatings are applied to these preforms which are degasified by a vacuum at elevated temperatures. The coated preforms are heated under a vacuum to a temperature such that the coating is densified to the extent that it becomes non-porous.

Gessinger U.S. Pat. No. 4,110,131 describes the powder metallurgic production of a high temperature alloy body. Moritoki et al U.S. Pat. No. 4,448,747 discloses a high density sintering method for powder molded products wherein the products are loaded into a heating furnace. Preliminary sintering of the products takes place in the furnace while the furnace is located in a chamber under vacuum.

Ecer U.S. Pat. No. 4,554,130 describes a method of consolidation of a part from separate metallic components. A binder is burned off at elevated temperatures, and pressure is used to consolidate the powdered metal. Ecer U.S. Pat. No. 4,673,549 discloses a method for the manufacture of objects by the consolidation of powdered metals and the like. A metal or ceramic can holds a shaped shell. The shell, as well as the space between the shell and can, are both filled with powder. The can is then out-gassed and sealed. Pressing is used to consolidate the powder into a dense form.

Smarsly et al U.S. Pat. No. 4,599,215 discloses a method for producing compressed moldings from loose or sintered metal powder. A flow die is compressed in a cavity block to thereby compress metal powder contained in a hermetically sealed capsule.

DISCLOSURE OF THE INVENTION

The objects of the invention are achieved by a single step hot isostatic pressing (HIP) canning of composite specimens made from arc-sprayed and plasma sprayed monotape. Each specimen is placed inside of a refractory metal ring and sandwiched between two refractory metal sheets. The resultant assembly is placed in a die which is loaded in a hot vacuum press. The temperature is raised in the vacuum to remove trapped residual gas and burn off contaminants.

The temperature and pressure are raised to values sufficient to cause deformation of the refractory metal ring and a solid state diffusion weld to occur between the ring and the face sheets. This deformation continues until the composite specimen partially densifies, thereby locking the specimen geometry in place. A perfectly fitted, clean, out-gassed HIP can sealed at high temperature and vacuum has now been created. The optimum situation now exists to complete the densification of the specimen by HIPPING.

DESCRIPTION OF THE DRAWINGS

The objects, advantages and novel features of the invention will be more fully apparent from the following detailed description when read in connection with the accompanying drawings wherein like numerals are used throughout to identify like parts.

DETAILED DESCRIPTION OF THE INVENTION

Figure 1:
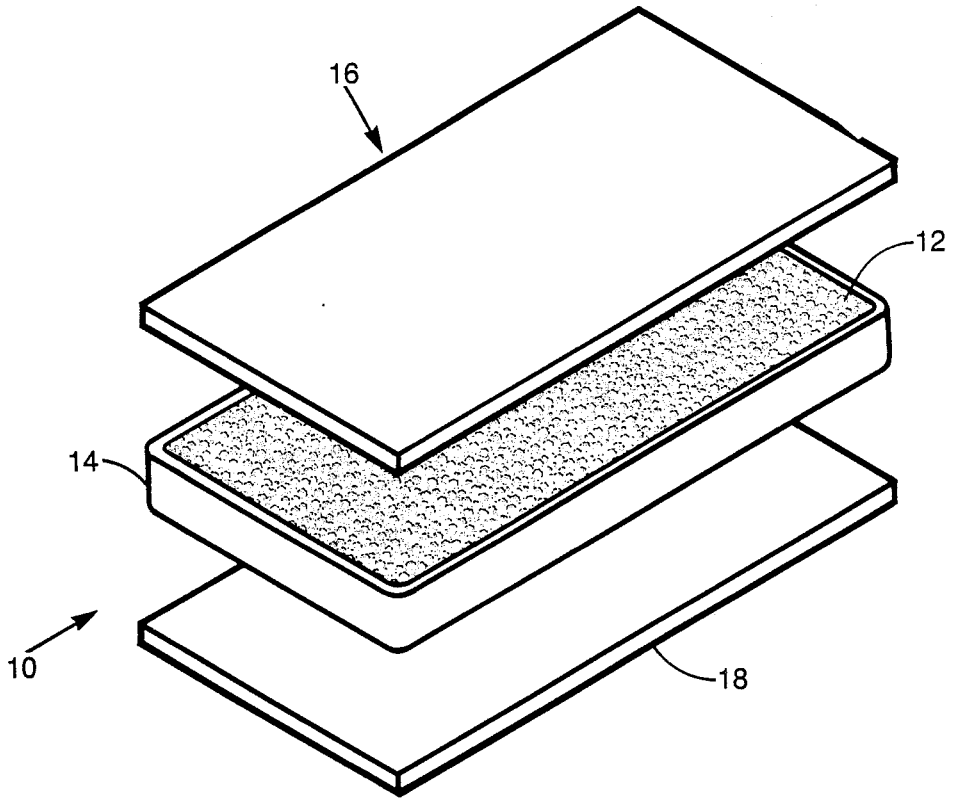
FIG. 1 is a perspective view showing a specimen assembled with the required component parts of the present invention.

Referring now to FIG. 1, there is shown an assembly 10 formed in accordance with the present invention. A specimen 12 comprising layers of arc-sprayed and plasma sprayed monotape is positioned within a metal ring or frame 14 which is interposed between a pair of face sheets 16 and 18.

The monotape in the specimen 12 may be made in accordance with the teachings of U.S. Pat. No. 4,518,625 to Westfall. The ring 14 and the face sheets 16 and 18 are of a refractory metal.

Figure 2:
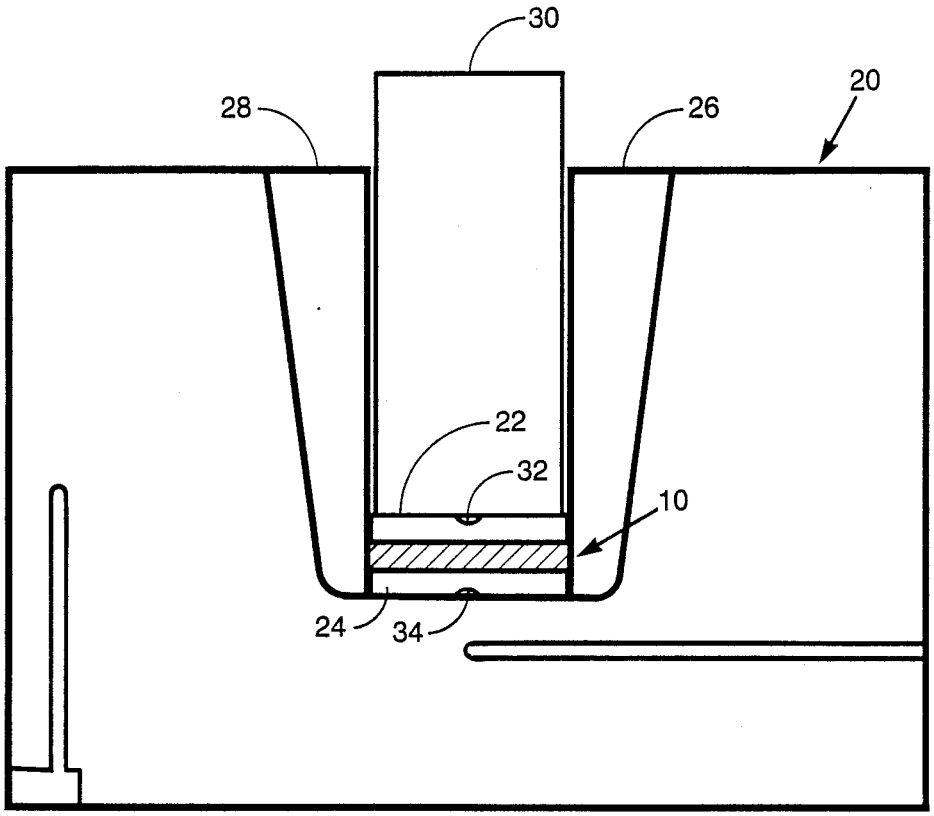
FIG. 2 is a schematic view showing the assembly of FIG. 1 positioned in a channel die.

The assembly 10 is placed in a molybdenum channel die 20 as shown in FIG. 2. More particularly, the specimen assembly 10 is positioned between a pair of pressure plates 22 and 24 that are located between a pair of spaced knockout wedges 26 and 28.

A punch 30 is mounted for reciprocating motion between the wedges 26 and 28. The outermost end of the punch 30 engages the surface of the pressure plate 22 that is opposite the face which engages the specimen assembly 10. A thermocouple 32 is provided in the pressure plate 22, while a similar thermocouple 34 is mounted in the opposite pressure plate 24.

Figure 3:
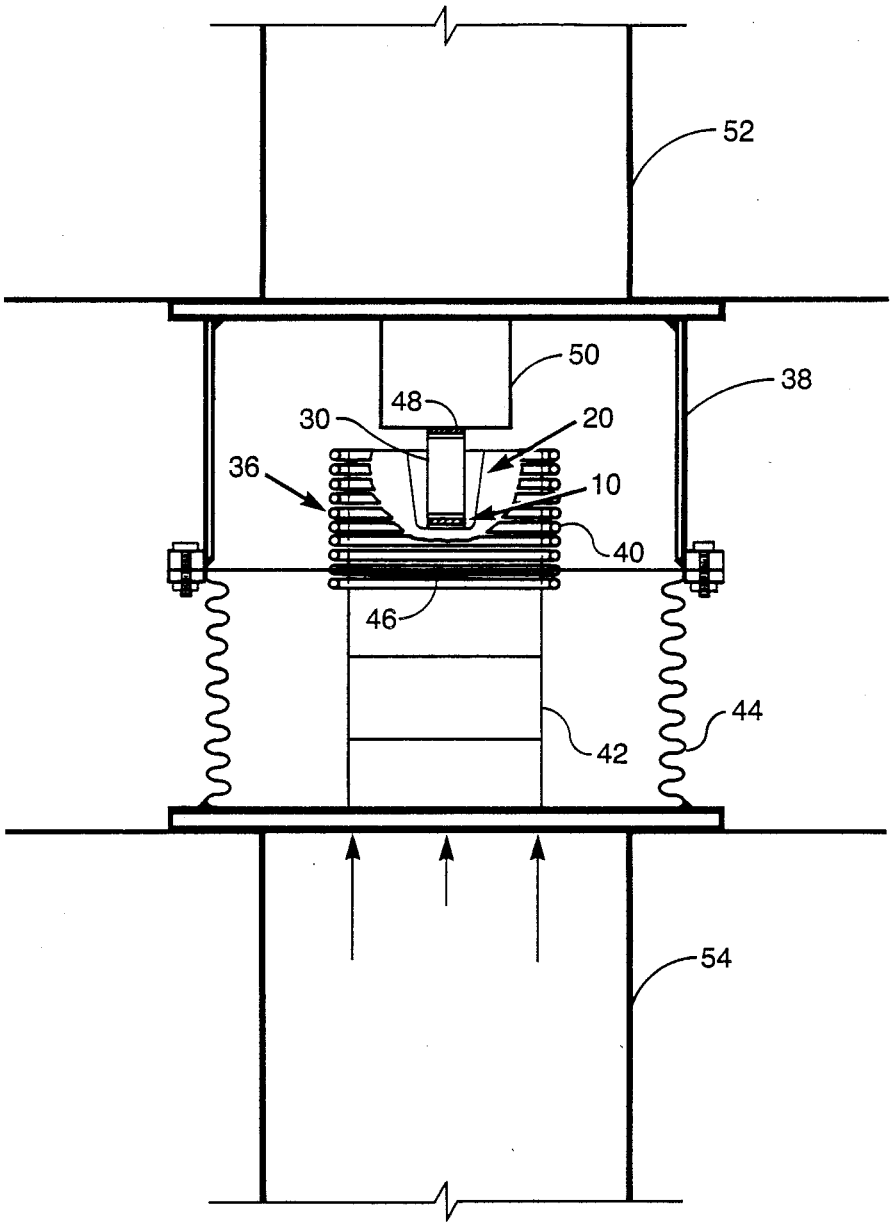
FIG. 3 is a schematic view showing the die of FIG. 2 positioned in a hot vacuum press.

The channel die 20 with the specimen assembly 10 therein is mounted in a hot press 36 that is contained in a vacuum chamber 38 as shown in FIG. 3. More particularly, the hot press 36 utilizes an induction coil 40 which surrounds the die 20 that is supported by a molybdenum pedestal 42. A stainless steel bellows 44 encircles the pedestal 42 to maintain the vacuum environment. The temperature is raised to a value sufficiently high, in a high vacuum atmosphere, to cause any trapped residual gas to leave the specimen, and any contaminants to "burn off" leaving a completely clean outgassed specimen.

Insulation 46 in the form of zirconia sheets thermally isolates the die 20 from the pedestal 42. Likewise, insulation 48 in the form of similar zirconia sheets thermally isolates the punch 20 from a steel ram 50 on a press 52. The pedestal 42 is carried by base 54 which is opposite the press 52. This base is capable of supporting loads up to 250,000 lbs. as indicated by the arrows in FIG. 3.

The specimen assembly 10 is heated in the vacuum 38 by the coils 40 to an elevated temperature. Load is applied by the press 52 through the steel ram 50 and punch 30. The temperature and pressure are raised to values sufficient to cause deformation of the refractory metal ring 14.

A solid state diffusion weld occurs between the ring 14 and the face sheets 16 and 18. This deformation continues until the composites specimen 12 partially densifies. This locks the specimen geometry in place.

A perfectly fitted, clean, outgassed HIP can sealed at high temperature and vacuum has been created. The optimum situation now exists to complete the densification of the specimen by HIPPING.

It will be appreciated by those skilled in the art that the novel process provides for the sealing of the composite in the HIP can of compatible refractory metal in a single operation. This eliminates the extra cost of forming and electron beam welding separate HIP cans.

Also, the HIP cans are sealed at high vacuum and at high temperature thereby assuring no outgassing will occur during the HIP process. This is important as out-gassing inside the can would prevent complete densification and could cause interstitial contamination leading to embrittlement of the specimen. The geometry and uniformity of the specimen are maintained due to the optimum fitting HIP can. This prevents specimen warpage caused by uneven stresses that can occur in conventional HIP canning procedures.

Because it is not necessary to electron beam weld the HIP can, recrystallization of the weld area does not occur. This eliminates the possibility of a cracking failure of the can. The cost and labor of duplicating failed specimens are saved.

While the preferred embodiment of the invention has been shown and described, it will be appreciated in various structural and procedural modifications may be made without departing from the spirit of the invention and the scope of the subjoined claims. By way of example, because of compatibility differences between specimen material and the rings and face sheets, different refractory materials can be used with equal success.

I claim:

1. A method of canning a composite formed from a sprayed porous monotape having trapped contaminants and gas prior to hot isostatic pressing comprising the steps of enclosing said composite with a metal frame adjacent the outer peripheral surface thereof, interposing said composite and frame between spaced face sheets to form an assembly, positioning said assembly in a die, loading said die and assembly into a vacuum hot press, heating said composite in a vacuum to a first temperature, sufficiently high to cause trapped gas to leave the composite and contaminants to burn off, maintaining said composite at said first temperature while applying a pressure load to said die, heating said composite to a second temperature that is substantially higher than said first temperature while increasing said pressure load, said second temperature and pressure being raised to values sufficient to deform said metal frame, maintaining said composite at said second temperature while deforming said frame and producing a solid state diffusion weld between said frame and said face sheets, and partially densifying said composites thereby establishing the geometry of the same.

2. A method of canning a composite as claimed in claim 1 wherein said frame comprises a refractory metal ring.

3. A method of canning a composite as claimed in claim 2 wherein said monotape is arc-sprayed.

4. A method of canning a composite as claimed in claim 2 where said monotape is plasma sprayed.

5. In a method of hot isostatic pressing a metallurgy composite comprising porous sprayed monotape having trapped contaminants and gas, an improved canning process including heating said composite between face plates separated by a frame that surrounds said monotape to cause trapped gas to leave the composite and contaminants to burn off, and applying a pressure load to said composite in a vacuum at a higher temperature at which the frame is deformed and a solid state diffusion weld is produced between said face plates and said frame thereby partially densifying said composite to lock the monotape in place in a can.

6. A method of hot isostatic pressing a metallurgy composite as claimed in claim 5 wherein said frame and said face plates are metal.

7. A method of hot isostatic pressing a metallurgy composite as claimed in claim 6 wherein said frame and face plates are a refractory metal.

8. A method of hot isostatic pressing a metallurgy composite as claimed in claim 5 wherein the frame is deformed and the solid state diffusion weld is formed by applying a pressure load to said face plates.

9. A method of hot isostatic pressing a metallurgy composite as claimed in claim 8 wherein the pressure load is applied to a die carrying said composite.

10. In a method of hot isostatic pressing a metallurgy composite containing porous sprayed monotape, an improved canning process comprising enclosing said composite in a can, removing trapped residual gas while burning off contaminants from said enclosed composite, and raising the temperature of said composite while simultaneously applying a pressure load to said can to seal the same so that no out-gassing will occur subsequent during hot isostatic pressing.

11. An improved method as claimed in claim 10 including deforming the can at an elevated temperature to produce a solid state diffusion weld around said composite.

12. An improved method as claimed in claim 11 wherein the can is deformed by applying the pressure load.

* * * * *